US010374321B2

(12) United States Patent
Evtyushkin et al.

(10) Patent No.: US 10,374,321 B2
(45) Date of Patent: Aug. 6, 2019

(54) ANTENNA DEVICE INCLUDING PARABOLIC-HYPERBOLIC REFLECTOR

(71) Applicant: Samsung Electronics Co., Ltd., Suwon-si, Gyeonggi-do (KR)

(72) Inventors: Gennadiy Aleksandrovich Evtyushkin, Moscow (RU); Artem Yurievich Nikishov, Moscow (RU); Anton Sergeevich Lukyanov, Moscow (RU); Elena Aleksandrovna Shepeleva, Kostroma (RU); Alexander Nikolaevich Khripkov, Moscow (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 172 days.

(21) Appl. No.: 15/661,557

(22) Filed: Jul. 27, 2017

(65) Prior Publication Data

US 2018/0131101 A1 May 10, 2018

(30) Foreign Application Priority Data

Nov. 9, 2016 (RU) ..... 2016143930
Jun. 1, 2017 (KR) ..... 10-2017-0068514

(51) Int. Cl.

| | |
|---|---|
| ***H01Q 1/24*** | (2006.01) |
| ***H01Q 3/30*** | (2006.01) |
| ***H01Q 15/16*** | (2006.01) |
| ***H01Q 19/17*** | (2006.01) |

(52) U.S. Cl.

CPC ..... *H01Q 15/16* (2013.01); *H01Q 1/246* (2013.01); *H01Q 3/30* (2013.01); *H01Q 19/175* (2013.01)

(58) Field of Classification Search

CPC ..... H01Q 15/16; H01Q 19/175; H01Q 1/246; H01Q 3/30

See application file for complete search history.

(56) References Cited

U.S. PATENT DOCUMENTS 3,775,769 A * 11/1973 Heeren ..... G01S 13/685 342/376
2011/0316755 A1 12/2011 Ayatollahi et al.
2014/0361924 A1 12/2014 Lieven

FOREIGN PATENT DOCUMENTS

| | | | |
|---|---|---|---|
| JP | 2002-198730 | A | 7/2002 |
| KR | 2002-0009151 | A | 2/2002 |
| KR | 10-1457931 | B1 | 11/2014 |
| WO | 03/017422 | A1 | 2/2003 |

* cited by examiner

*Primary Examiner* — Daniel Munoz
(74) *Attorney, Agent, or Firm* — Jefferson IP Law, LLP

(57) ABSTRACT

An antenna device is provided. The antenna device includes a reflector having a profile of a parabolic shape in a first cross-section cut parallel to a first direction and a profile of a hyperbolic shape in a second cross-section, the second cross-section being cut perpendicular to the first direction and crossing the first cross-section at a right angle and a radiating structure having at least one phased antenna array adapted to illuminate at least part of the reflector and to scan a beam. The edges of the profile of the parabolic shape of the first cross-section are formed to be directed toward the radiating structure. The edges of the profile of the hyperbolic shape of the reflector are formed to be directed away from the radiating structure. The antenna device may be diversified depending on various embodiments.

16 Claims, 19 Drawing Sheets

ANTENNA DEVICE INCLUDING PARABOLIC-HYPERBOLIC REFLECTOR

CROSS-REFERENCE TO RELATED APPLICATION(S)

This application claims the benefit under 35 U.S.C. § 119(a) of a Russian patent application filed on Nov. 9, 2016 in the Russian Patent Office and assigned Serial number 2016143930 and of a Korean patent application filed on Jun. 1, 2017 in the Korean Intellectual Property Office and assigned Serial number 10-2017-0068514, the entire disclosure of each of which is hereby incorporated by reference.

TECHNICAL FIELD

The present disclosure relates to antenna devices. More particularly, the present disclosure relates to an antenna device including a reflector.

BACKGROUND

Constantly increasing demands of users motivates rapid development of mobile communication technologies. Currently, fifth generation (5G) millimeter-wave networks are being actively developed. The 5G millimeter-wave networks may require higher performance based on user experience and including such factors as ease of connectivity with nearby devices and improved energy efficiency. Millimeter-wave technologies encounter a variety of fundamental challenges, which are associated with physics of antenna arrays, structure of a high-speed transceiver, and the like.

Still remaining main tasks for integration of millimeter-wave antennas are to reduce cost, decrease interference level, and provide required communication quality and energy efficiency. Further, a communication channel shall maintain stability when a communicating mobile device changes its position. Accordingly, the following requirements may be imposed on e.g., antennas of base stations:

1) high gain,
2) wide scan angles,
3) high directivity,
4) low sidelobe level,
5) dual-polarized beamforming to increase rate and improve stability of data transmission, and
6) high efficiency of the antenna.

FIG. 1 shows configuration of antennas in a base station according to the related art.

Referring to FIG. 1, a very important task in operation of scanning antennas is to increase the scan angle, which in turn may enhance the efficiency of the system. The scan angle of a traditional antenna array is generally restricted by ±45 degrees in order not to cause a significant reduction in gain and an excessive increase in the sidelobe level. Therefore, as shown in FIG. 1, in configuring a traditional base station (or BS), four antennas BSA1, BSA2, BSA3, and BSA4 each having a scan angle of ±45 degrees, may be arranged to cover an area of 360 degrees around the base station. The use of three antennas instead of four, to cover the entire coverage area (i.e., to provide a desired level of waves for the entire coverage area), could significantly alleviate requirements for the complexity of control and distribution devices on the side of the base station transceiver, decrease the base station dimensions, and simplify and speed up installation of the base station. Therefore, to configure a base station with three antennas, it would be desirable that each of the three antennas has a scan angle of more than ±60 degrees not less than ±60 degrees.

To expand the scan angle in the millimeter-wave communication frequency range, special means may be required. For example, a conformal antenna array (cylindrical type), Luneburg lens antennas, and switched axisymmetric antennas are currently used for increasing the scan angle. These types of antennas may provide a scan angle of ±90 and more. However, they have some disadvantages: namely, they include a sophisticated switching unit that introduces additional loss, require large spatial dimensions, and have low efficiency of the antenna aperture.

Traditional antenna arrays may obtain an extended scanning beam by means of special structures installed in front of the array. These structures may cause additional deviation of the wave front, and are generally used for large broad-side arrays.

There are some millimeter-wave solutions that approach the aforementioned requirements to some extent according to the related art.

FIGS. 2, 3, 4, and 5 show examples of millimeter-wave antennas according to the related art.

Referring to FIG. 2, the publication "An E-band Cylindrical Reflector Antenna for Wireless Communication Systems" 7th European Conference on Antennas and Propagation (EUCAP2013)" discloses a cylindrical reflector antenna designed for high frequency applications and having a high gain and relatively low losses. However, this antenna is incapable of scanning, has an efficiency of about 60% and operates with a single polarization only.

Referring to FIG. 3, another antenna of the related art for application at 23 GHz frequencies is disclosed in the publication "Cylindrical-parabolic reflector with printed antenna structures" IHTM-CMTM, University of Belgrade Journal of Microelectronics, Electronic Components and Materials, Vol. 43, No. 2(2013), 97-102. The disclosed antenna has a radiating structure in the form of a microstrip antenna array of dipoles, and a cylindrical reflector. Like the previous example, this antenna has no scanning ability and operates with a single polarization only. Furthermore, a microstrip feeder of the antenna disclosed by the university of Belgrade journal operates with an efficiency of only 56% because the losses in feeding radiators reach 2-3 dB. In the millimeter-wave communication, the losses in the microstrip feeder may further increase due to dielectric material loss and manufacturing defects (any irregularities, thickening, narrowing, notches, curvatures, corners, etc. may cause re-reflection, parasitic radiation, etc.). Therefore, the distributed system of the feeder path may be a disadvantage for millimeter antennas.

Referring to FIG. 4, another antenna of the related art is disclosed in the publication "The Design on the Antenna Array with High Gain and Scanning Beam" Lu Zhiyong, the 54th Research Institute of CETC, Shijiazhuang, 050081, China, International Conference on Microwave and Millimeter Wave Technology (ICMMT), 2012. A cylindrical (parabolic) reflector is illuminated by a special array to form a scanning beam. This antenna, like the previous antennas, operates with a single polarization and has a relatively low efficiency (about 60%). Furthermore, the antenna has a very limited scan angle (±20 degrees), so nine antennas are required to cover an area of 360 degrees, and given its extreme complexity, the use of such an antenna in base stations for mobile communications is hardly suitable.

Referring to FIG. 5, as another millimeter-wave antenna, Thomson CSF Radar Maser-T antenna has been proposed. The antenna is a complex scanning antenna array consisting of a plurality of linear microstrip antenna arrays, and the scanning antennas are connected to the respective transceiver circuits. However, despite all the complexity, this antenna is restricted by a scan angle of ±40 degrees, and its microstrip structure may cause high loss in the feeder lines and low antenna efficiency.

Such technologies of the related art are not suitable for providing antenna devices, which could simultaneously meet all of the above requirements.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device capable of dual-polarized beamforming and having increased scan angle.

In accordance with an aspect of the present disclosure, an antenna device is provided. The antenna device includes a reflector having a profile of a parabolic shape in a first cross-section cut parallel to a first direction and a profile of a hyperbolic shape in a second cross-section, the second cross-section being cut perpendicular to the first direction and crossing the first cross-section at a right angle, and a radiating structure having at least one phased antenna array adapted to illuminate at least part of the reflector and to scan a beam. The edges of the profile of the parabolic shape of the first cross-section are formed to be directed toward the radiating structure. The edges of the profile of the hyperbolic shape of the reflector are formed to be directed away from the radiating structure.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other objects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
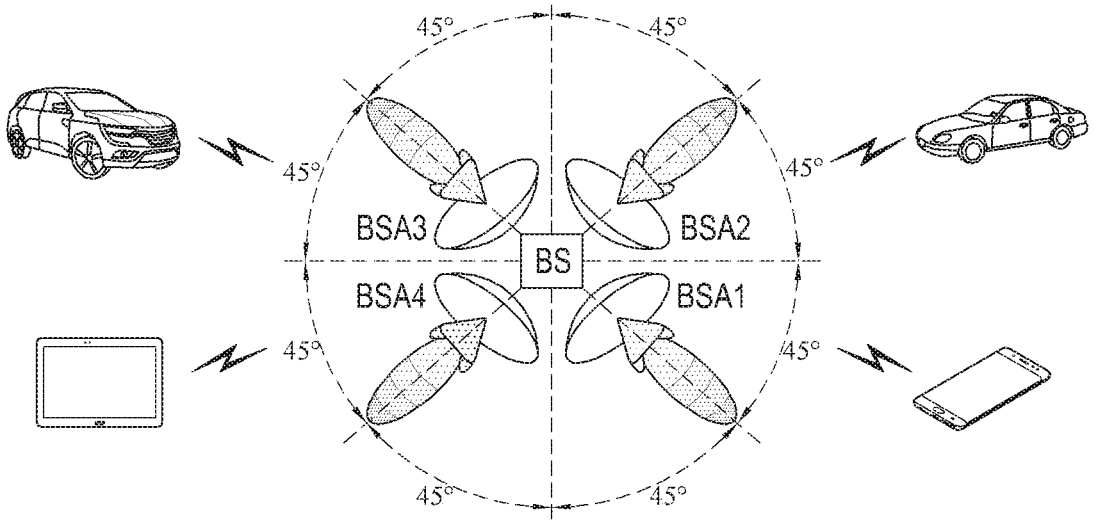
FIG. 1 (RELATED ART)
FIG. 1 shows configuration of antennas in a base station according to the related art.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

Furthermore, relative terms like 'front', 'back', 'top', 'bottom', etc., set forth with respect to what are shown in the drawings may be replaced with ordinal terms like 'first ~', 'second ~', etc. The ordinal terms may be defined arbitrarily or in the order of being mentioned, and may be arbitrarily changed as necessary.

It will be further understood that the terms "comprises" and/or "comprising," when used in this specification, specify the presence of stated features, integers, operations, elements, and/or components, but do not preclude the presence or addition of one or more other features, integers, operations, elements, components, and/or groups thereof.

Unless otherwise defined, all terms including technical and scientific terms used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 6:
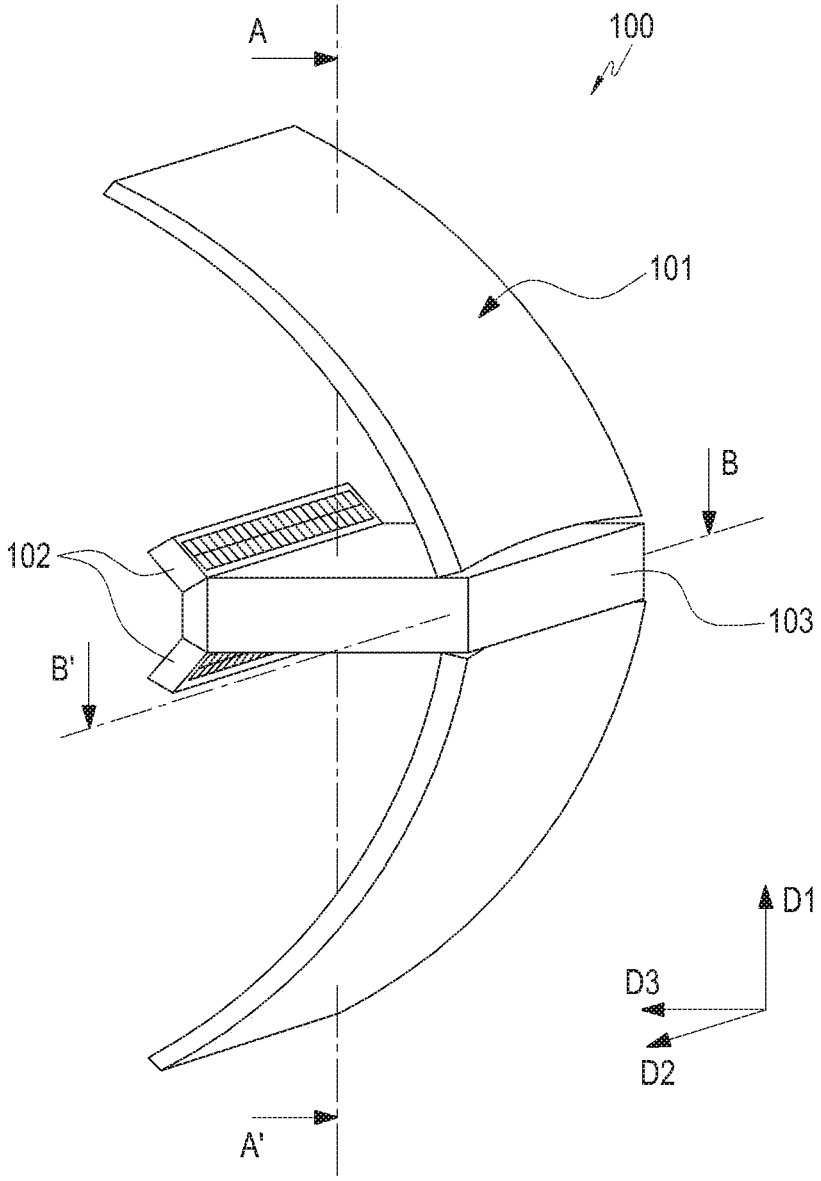
FIG. 6 is a perspective view of an antenna device, according to various embodiments of the present disclosure.

FIG. 6 is a perspective view of an antenna device, according to various embodiments of the present disclosure.

Figure 7:
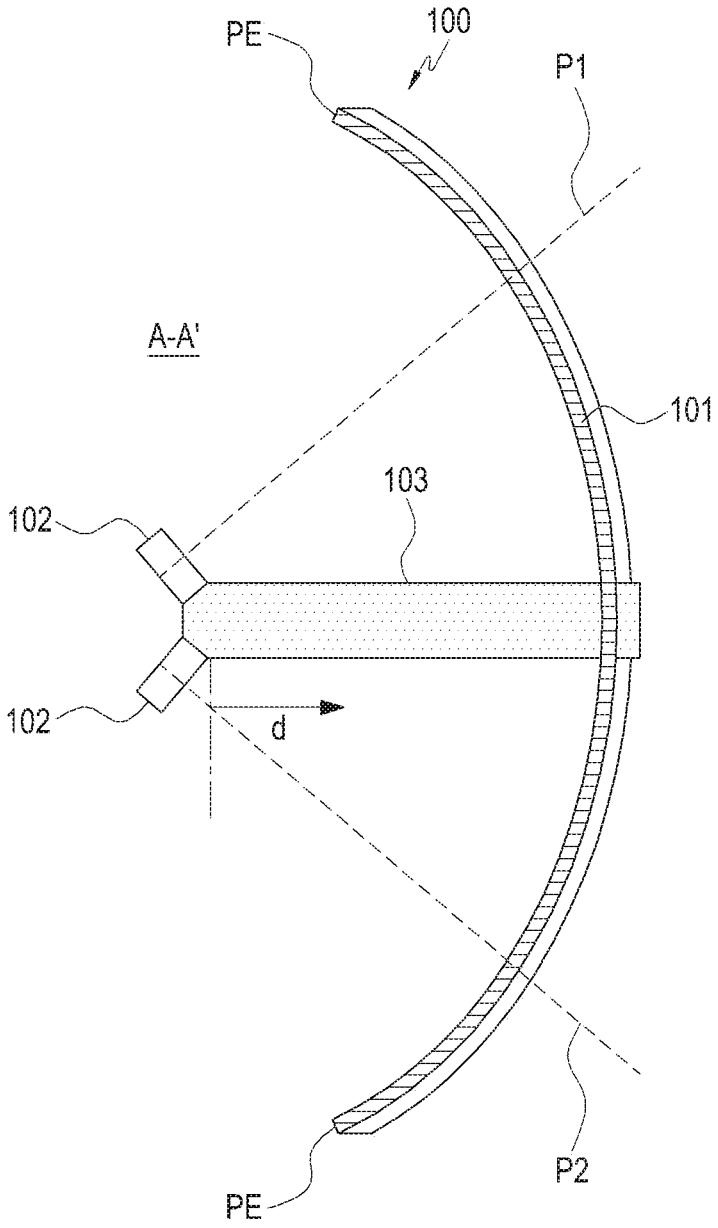
FIG. 7 is a cross-sectional view of an antenna device cut along a line A-A' in FIG. 6 according to an embodiment of the present disclosure.

FIG. 7 is a cross-sectional view of an antenna device cut along a line A-A' in FIG. 6 according to an embodiment of the present disclosure.

Figure 8:
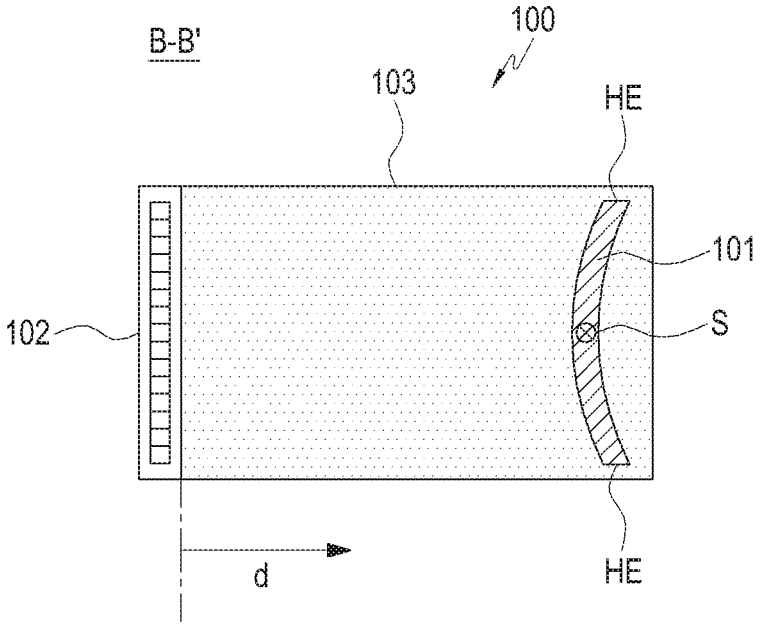
FIG. 8 is a cross-sectional view of an antenna device cut along a line B-B' in FIG. 6 according to an embodiment of the present disclosure.

FIG. 8 is a cross-sectional view of an antenna device cut along a line B-B' in FIG. 6 according to an embodiment of the present disclosure.

Referring to FIGS. 6 to 8, an antenna device 100 in accordance with various embodiments of the present disclosure may include a reflector 101 and a radiating structure (e.g., phased antenna array 102). The radiating structure may include at least one phased antenna array 102, which may be arranged to illuminate at least part of the reflector 101. For example, the phased antenna array 102 may emit (radio) waves toward the reflector 101, or receive at least part of waves that enters from outside and are reflected from the reflector 101.

According to various embodiments, if the radiating structure includes one of the single phased antenna array 102, the phased antenna array 102 may illuminate substantially the entire area of the reflector 101. In an embodiment, if the radiating structure includes a plurality of (e.g., at least two) phased antenna arrays 102, each of the phased antenna array 102 may illuminate a different part of the reflector 101. For example, referring to FIGS. 6 and 7, one of the two phased antenna arrays 102 may illuminate the upper half of the reflector 101 while the other may illuminate the lower half of the reflector 101.

In the following description, in FIG. 6, the first direction D1 may refer to an opposite direction to gravity; the second direction D2 may refer to a direction in which radiators (e.g., waveguide antennas 102*a* of FIG. 13) constituting the phased antenna array 102 are arranged, and which is perpendicular to the first direction D1; the third direction D3 may refer to a direction perpendicular both to the first and second directions D1 and D2. In some embodiments, the first direction D1 may refer to a direction inclined to gravity (or to the opposite direction) depending on the environment where the antenna device 100 is installed or on the actual installation state. In the following description, DX, where X is a natural number, may be used to indicate a direction or a plane positioned in a direction.

In an embodiment, the reflector 101 and the radiating structure may be interconnected via a supporter 103. For example, in the third direction D3, the reflector 101 may be installed at one end of the supporter 103 and the radiating structure (e.g., the phased antenna array 102) may be installed at the other end of the supporter 103. As mentioned above, the radiating structure, e.g., the phased antenna array(s) 102 may be arranged to illuminate at least part of the reflector 101.

In various embodiments, the reflector 101 may have the form of a curved plate that at least partially encloses the surroundings of the radiating structure. For example, viewed from the radiating structure, the first cross-section(s) of the reflector 101 cut in a direction may have a profile of a parabolic shape, and the second cross-section(s) of the reflector 101 cut in another direction (e.g., a direction perpendicular to the first cross-section) may have a profile of a hyperbolic shape.

According to various embodiments, the first cross-section (s) may refer to the cross-section of the reflector 101 and/or the antenna device 100 cut along a plane e.g., orthogonal to the D2-D3 plane and parallel or inclined to the D1-D3 plane. For example, a cross-section shown in FIG. 7 is the first cross-section that is parallel to the D1-D3 plane and obtained by cutting the reflector 101 and/or the antenna device 100 along the plane that is parallel to the plane D1-D3 and has the line A-A' of FIG. 6 (hereinafter, referred to as the first vertical plane). The cross-section may refer to a cross-section of the reflector 101 and/or a cross section of the entire antenna device 100. In the first cross-section, the reflector 101 may have a profile of a parabolic shape around the radiating structure (e.g., the phased antenna array 102). In an embodiment, the edge(s) PE of the profile of the parabolic shape of the reflector 101 (e.g., of the first cross-section) may be formed to be directed toward the radiating structure. For example, if a distance d from the radiating structure to an arbitrary part of the reflector 101 is measured along the third direction D3, the edges PE of the profile of the parabolic shape may be at the closest positions to the radiating structure. According to various embodiments, if the reflector 101 and/or the antenna device 100 is cut along the planes parallel or inclined to the first vertical plane, the respective parabolic profiles may be partially different from one another. For example, depending on the necessary scan angle, directivity, gain, etc., for the antenna device 100, the profile of the reflecting plane of the reflector 101 may vary.

According to various embodiments, the second cross-section(s) may refer to a cross-section of the reflector 101 and/or the antenna device 100 cut along a plane e.g., perpendicular to the D1-D3 plane and parallel or inclined to the D2-D3 plane. For example, a cross-section shown in FIG. 8 is the second cross-section that appears from cutting the reflector 101 and/or the antenna device 100 along a plane that is parallel to the D2-D3 plane and has the line B-B' of FIG. 6 (hereinafter, referred to as the first horizontal plane). The cross-section may refer to a cross-section of the reflector 101 and/or a cross section of an entirety of the antenna device 100. In the second cross-section, the reflector 101 may have a profile of a hyperbolic shape with respect to the radiating structure (e.g., the phased antenna array 102). In an embodiment, the edge(s) HE of the profile of the hyperbolic shape of the reflector 101 (e.g., of the second cross-section) may be formed to be directed away from the radiating structure. For example, if the distance d from the radiating structure to an arbitrary part of the reflector 101 is measured along the third direction D3, the edges HE of the profile of the hyperbolic shape may be at the farthest positions from the radiating structure. According to various embodiments, if the reflector 101 and/or the antenna device 100 is cut along the planes parallel or inclined to the second horizontal plane, the respective profiles of hyperbolic shape may be partially different from one another. For example, depending on the necessary scan angle, directivity, gain, etc., for the antenna device 100, the profile of the reflecting plane of the reflector 101 may be determined.

Figure 13:
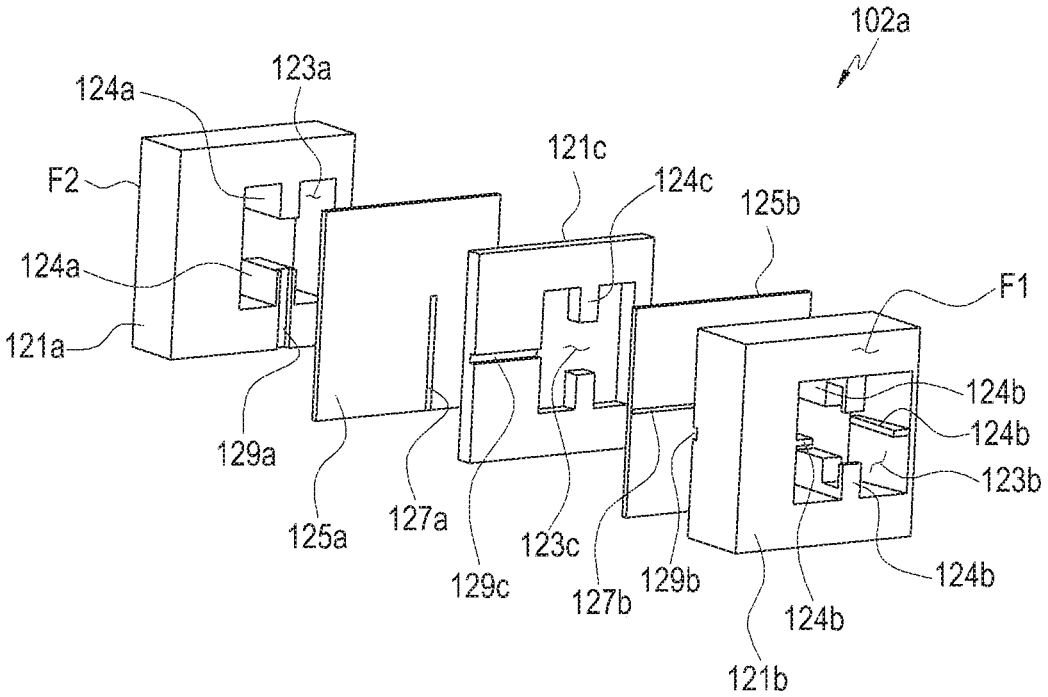
FIG. 13 is an exploded perspective view of an implementation of a phased antenna of an antenna device, according to various embodiments of the present disclosure.

In accordance with various embodiments, the phased antenna array 102 may include a plurality of phased antennas (e.g., waveguide antennas 102*a* of FIG. 13). For example, the plurality of phased antennas may be linearly arranged along the second direction D2 to form the phased antenna array 102. In an embodiment, the aforementioned phased antennas may be arranged on the same plane as one of the second cross-sections, e.g., a plane parallel to the second direction D2 including a line P1 or P2 of FIG. 7. In another embodiment, the phased antennas may be arranged in a direction orthogonal to a symmetry axis (e.g., an axis denoted by 'S' in FIG. 8) of the profile of the hyperbolic shape in the second cross-section.

Figure 9:
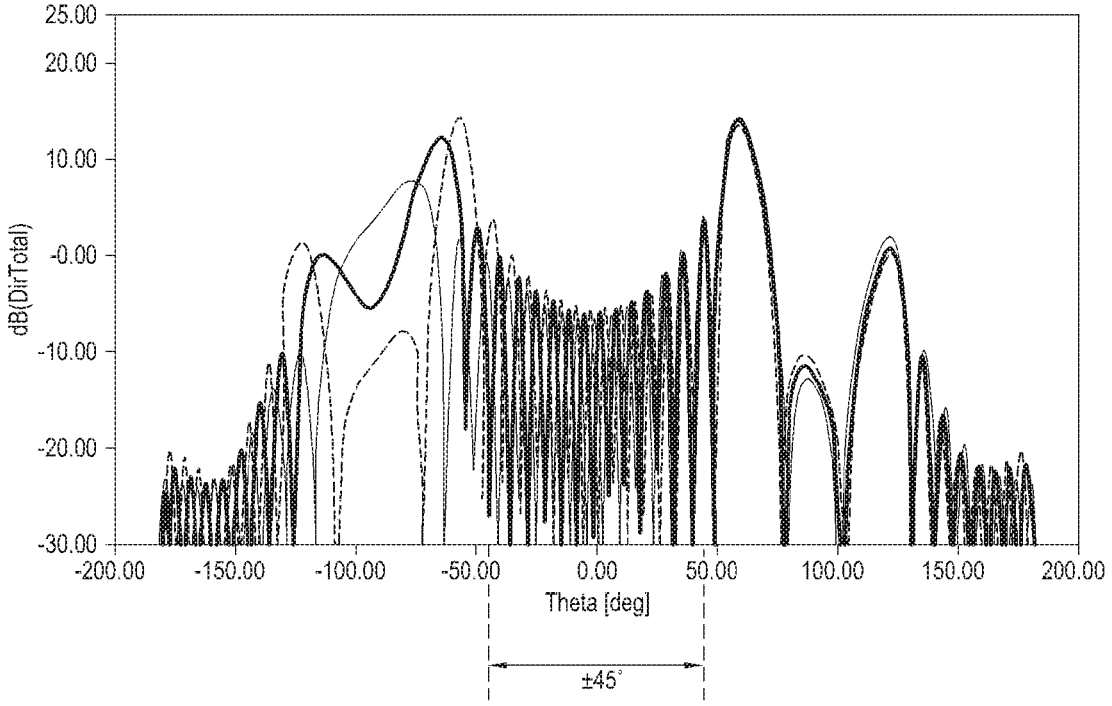
FIG. 9 (RELATED ART)
FIG. 9 is a graph representing measurements of radiation properties of an antenna device including a cylindrical or parabolic reflector of the related art according to an embodiment of the present disclosure.

FIG. 9 is a graph representing measurements of radiation properties of an antenna device including a cylindrical or parabolic reflector of the related art according to an embodiment of the present disclosure.

Figure 10:
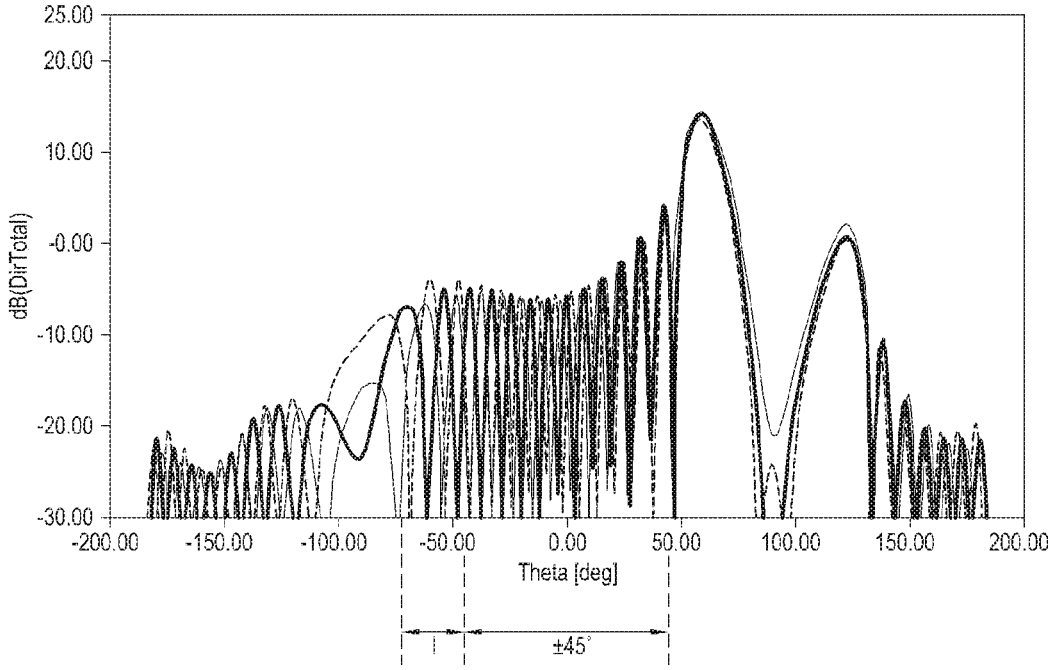
FIG. 10 is a graph representing measurements of radiation properties of an antenna device including a parabolic-hyperbolic reflector according to various embodiments of the present disclosure.

FIG. 10 is a graph representing measurements of radiation properties of an antenna device including a parabolic-hyperbolic reflector according to various embodiments of the present disclosure.

Referring to FIGS. 9 and 10, measurements of the radiation properties are to compare radiation properties based on the difference in shape or profile of the reflector, and other elements than the reflector are measured under the same conditions. The measurement was made in the respective frequency bands of 26.65 GHz, 27.925 GHz, and 29.2 GHz.

Figure 2:
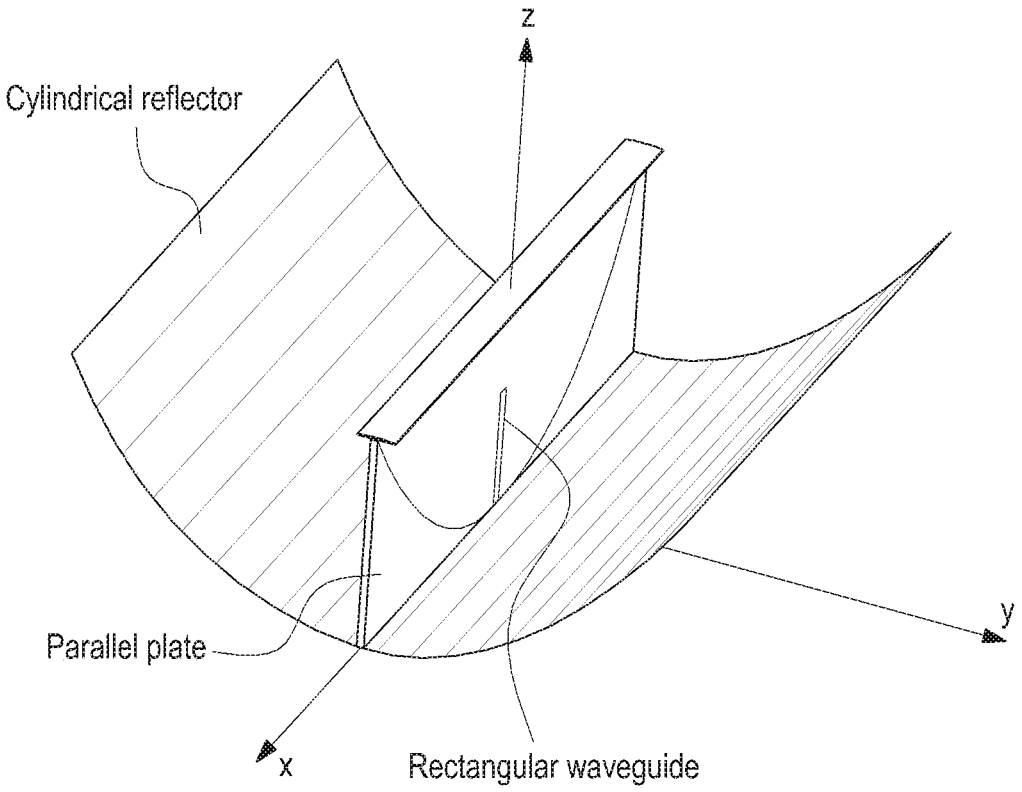
FIG. 2 (RELATED ART)
FIGS. 2, 3, 4, and 5 show examples of millimeter-wave antennas according to the related art.
Figure 3:
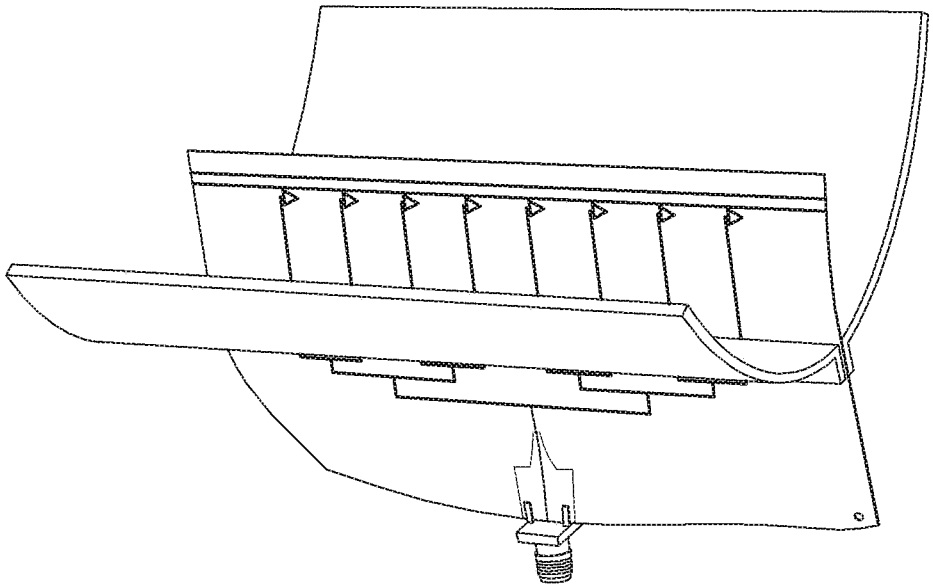
FIG. 3 (RELATED ART)
Figure 4:
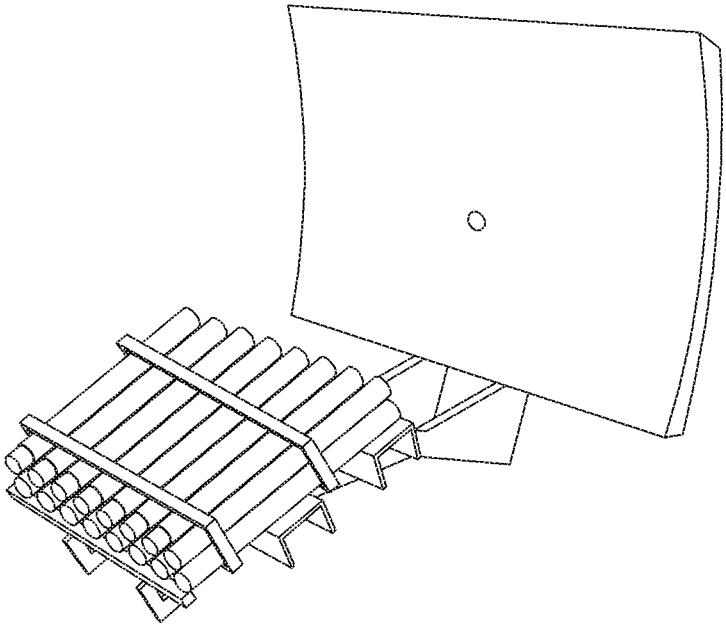
FIG. 4 (RELATED ART)
Figure 5:
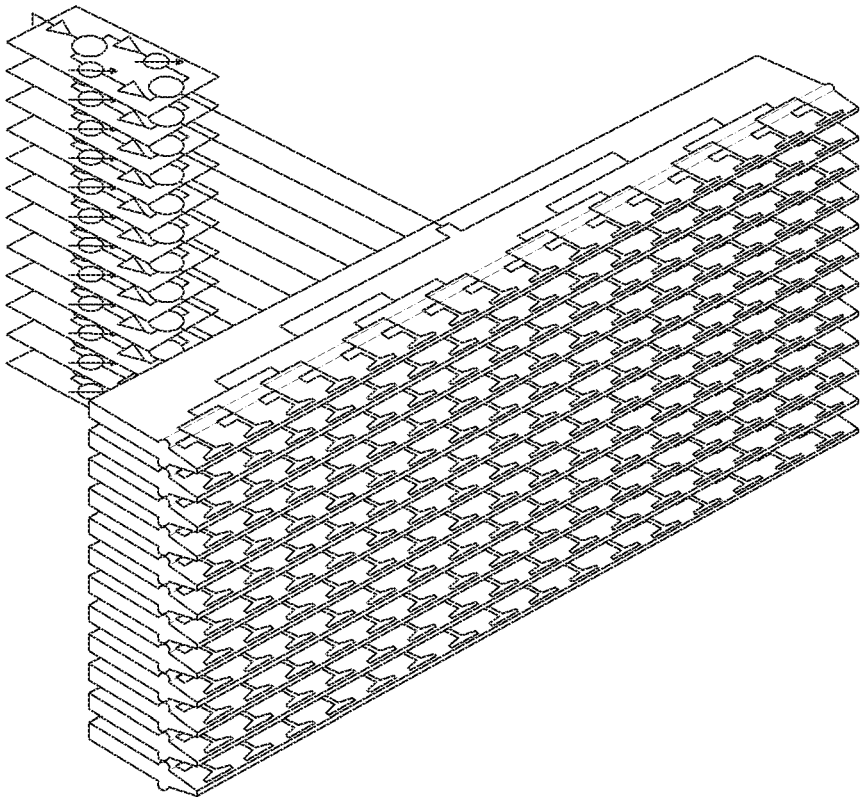
FIG. 5 (RELATED ART)

Referring to FIG. 9, a graph resulting from measurement of radiation patterns (e.g., directivity) of an antenna device (e.g., the antenna device of FIG. 2 or FIG. 3) including e.g., a reflector with a linear cross-section according to the related art is illustrated. As seen from FIG. 9, the antenna device of the related art generates a main beam at a diffraction angle greater than about +45 degrees and a parasitic diffraction lobe of a similar level to the main beam at a diffraction angle smaller than about −45 degrees. The main beam and/or parasitic diffraction lobe has an excessively strong transmission and reception level compared to a gain in a main direction (direction of about 0 degree), thereby reducing the gain in the main direction. Furthermore, the antenna device of the related art as described above may have a scan angle of about ±45 degrees, but the scan angle of the antenna device may be narrowed as the difference between the gain in the main direction and the gain of the main beam (and/or the parasitic diffraction lobe) increases.

Referring to FIG. 10, a graph resulting from measurement of radiation patterns (e.g., directivity) of an antenna device according to various embodiments of the present disclosure is illustrated, e.g., the antenna device 100 shown in FIG. 6. As seen from FIG. 10, with an antenna device in accordance with various embodiments of the present disclosure in comparison with the antenna device of the related art, generation of parasitic diffraction lobes is suppressed in a scan direction that exceeds about −45 degrees, and the transmission and reception levels (gains) in a certain range I (e.g., a range within about 30 degrees) in a scan direction that exceeds about −45 degrees remain as similar as the gain in the main direction. As such, as the generation of parasitic diffraction lobes is suppressed, the antenna device in accordance with various embodiments of the present disclosure may improve the gain in the main direction while the scan angle may be extended to an extent of the certain range I.

In an embodiment, compared with the gain of a range of the scan angle of FIG. 9, the measurement result reveals that the gain in the main direction is improved and overall gains in the range of scan angle (about ±45+I) are uniform (i.e., deviations decreases). For example, with the same other conditions, e.g., same arrangements or performances for other elements), the antenna device in accordance with various embodiments of the present disclosure may improve or at least maintain the gain, efficiency, directivity, etc., while increasing (expanding) the scan angle as compared with the antenna device of the related art. The fact that the profile of the hyperbolic shape (also referred to as the hyperbolic profile) reduces the image of an object means that, for example, applying the hyperbolic profile to the reflector illuminated onto the phased array antenna virtually reduces an electrical distance between radiating elements, e.g., phased antennas, which may explain comprehensive effects of improving or at least maintaining characteristics of the antenna device, e.g., gain, efficiency, directivity, etc., while increasing (expanding) the scan angle.

The reflector with the profile of the hyperbolic shape applied thereto may suppress generation of parasitic diffraction lobes, and if there is no parasitic diffraction lobe, the distance (e.g., the electric distance) between the phased antennas (e.g., the waveguide antennas 102*a* of FIG. 13) that form the phased antenna array may meet the following Equation 1:

$$a = \frac{\lambda}{1 - \sin(\theta_{max})} \qquad \text{Equation 1}$$

In Equation 1, $\alpha$ indicates an electric distance between the phased antennas, $\theta_{max}$ indicates the maximum beam diffraction angle, and $\lambda$ indicates a wavelength.

As expressed in Equation 1, using the reflector of a hyperbolic profile may reduce the electric distance between radiating elements, thereby increasing the scan angle, e.g., the maximum beam diffraction angle $\theta_{max}$. In some embodiments, as the curvature of the hyperbolic profile increases, the larger scan angle may be provided. With the reflector of a hyperbolic profile, the electric distance between the radiating elements may be reduced, but an actual distance between them may not change.

Figure 11:
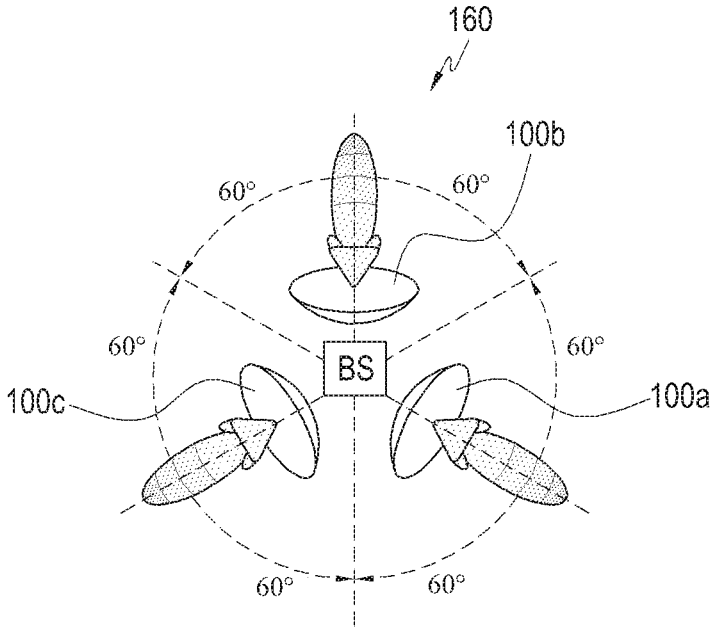
FIG. 11 shows a configuration of a base station with an antenna device according to various embodiments of the present disclosure.

FIG. 11 shows a configuration of a base station with an antenna device according to various embodiments of the present disclosure.

Referring to FIG. 11, the antenna device 100 may have a scan angle of more than about ±60 degrees in the D2-D3 plane. For example, in configuring a base station, if the antenna device 100 is installed such that the line A-A' is substantially parallel to the direction of gravity or perpendicular to the ground according to an installation environment, beam scanning for the entire coverage area on the D2-D3 plane, e.g., the range of 360 degrees, is possible by combining three antenna devices 100*a*, 100*b* and 100*c*. This may:

- improve or alleviate complexity of control and distribution devices on the side of the base station transceiver,
- reduce the number of antenna devices for beam scanning of the entire coverage area,
- enable simplification and speed up of installation of the base station as the number of antenna devices decreases, and
- improve energy efficiency.

Further, the radiation pattern formation performance on various elevation planes of the present disclosure may be improved better than the antenna device of the related art or may at least remain the same.

In an embodiment, the radiation structure, e.g., the phased antenna array 102 of FIG. 6 may have a similar form to a circle or rectangle, and may be located on the center axis of the antenna device 100. In another embodiment, the phased antenna array 102 may be arranged linearly and symmetrically on a horizontal plane around the center axis of the antenna device 100. In another embodiment, the phased antennas that form the phased antenna array 102 (e.g., the waveguide antennas 102*a* of FIG. 13) may be arranged on the same plane as one of the aforementioned second cross-sections (e.g., a second cross-section including the line P1 or P2 of FIG. 7 and located on a plane parallel to the second direction D2) and arranged in the perpendicular direction to the symmetry axis of the profile of the hyperbolic shape formed on the plane. The shape or arrangement of the radiating structure may be properly modified taking into account specifications required for the antenna device or an environment in which the antenna device is to be installed.

Configurations on a phased antenna array (e.g., the phased antenna array 102 of FIG. 6) of an antenna device (e.g., the antenna device 100 of FIG. 6), a phased antenna that makes up the phased antenna array (e.g., the waveguide antenna 102*a* of FIG. 13), a feeding structure of each phased antenna, etc., will be described with reference to FIGS. 12 to 17.

Figure 12:
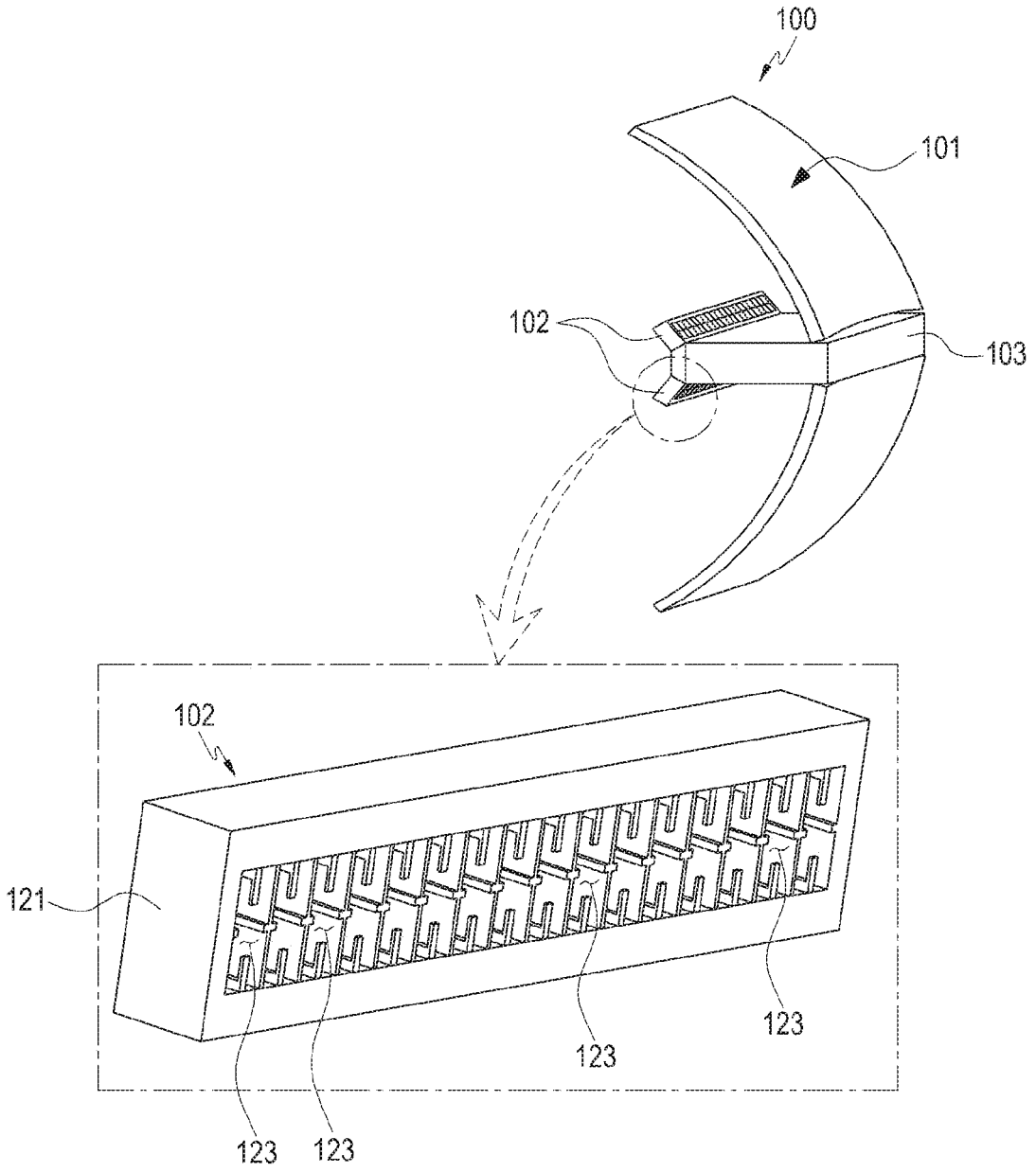
FIG. 12 is a perspective view of a phased antenna array of an antenna device, according to various embodiments of the present disclosure.

FIG. 12 is a perspective view of a phased antenna array of an antenna device, according to various embodiments of the present disclosure.

Referring to FIG. 12, the phased antenna array 102 may include a waveguide member 121 and a number of waveguides 123 formed in the waveguide member 121. The waveguides 123 may be linearly arranged in one direction (e.g., in parallel with the second direction D2), and placed on the same plane as one of the cross-sections of the hyperbolic profile of the reflector (e.g., the reflector 101 of FIG. 6). Each of the waveguides 123 has the form that extends in a different direction (e.g., a direction perpendicular to the second direction D2) and operates as an antenna for transmitting or receiving electric waves by being independently fed from one another or by being equally fed. In some embodiments, the waveguide antenna (e.g., the waveguide antenna 102*a* of FIG. 13) and/or the phased antenna array 102 may perform dual-polarized beamforming according to feeding structures applied to the waveguides 123, internal structures of the waveguides 123, etc. The feeding structures and internal structures of the waveguides 123 may be suitably designed taking into account suppression of parasitic radiation, gain, efficiency, etc., of the antenna device. The feeding structure or internal structure of the waveguide will be described in more detail in connection with FIG. 13.

FIG. 13 is an exploded perspective view of an implementation of a phased antenna of an antenna device, according to various embodiments of the present disclosure.

Figure 14:
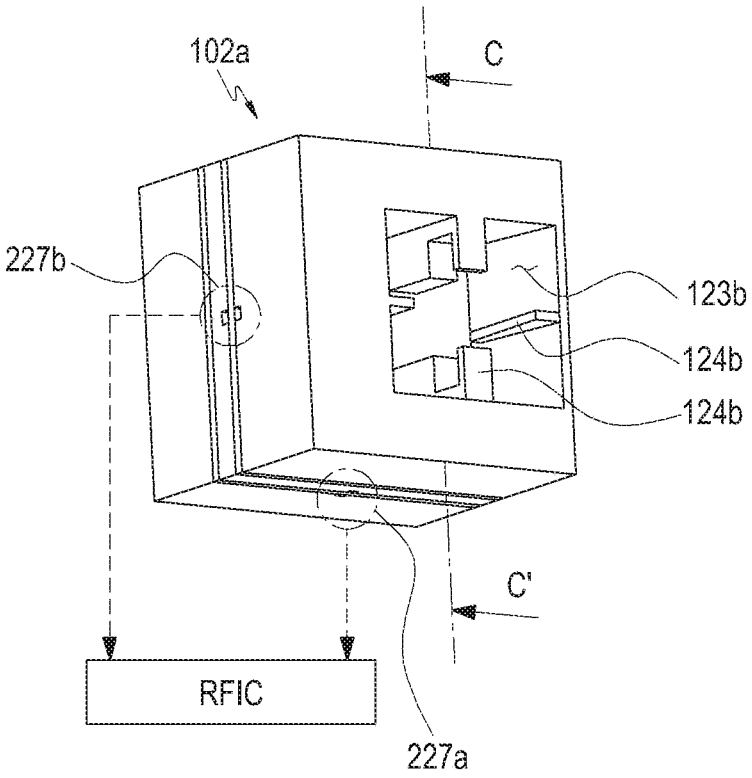
FIG. 14 shows an implementation of a phased antenna of an antenna device, according to various embodiments of the present disclosure.

FIG. 14 shows an implementation of a phased antenna of an antenna device, according to various embodiments of the present disclosure.

Figure 15:
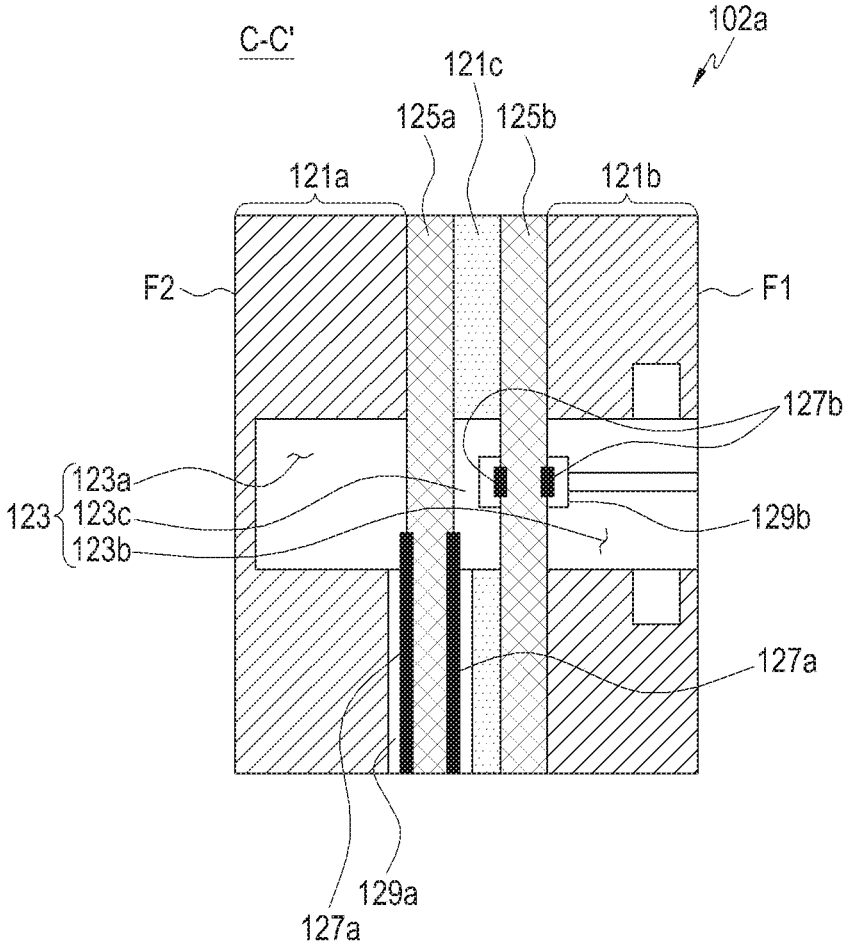
FIG. 15 is a cross-sectional view of a phased antenna cut along a line C-C' in FIG. 14 according to an embodiment of the present disclosure.

FIG. 15 is a cross-sectional view of the phased antenna cut along the line C-C' in FIG. 14, according to various embodiments of the present disclosure.

Referring to FIGS. 13 to 15, the phased antenna array 102 as described above in connection with FIG. 12 may be formed by combining a plurality of waveguides 123, which may operate independent antennas. For example, each of the waveguides 123 may form a waveguide antenna, and the waveguides 123 may be combined to form the phased antenna array 102. FIGS. 13 to 15 show a phased antenna that makes up the phased antenna array 102, e.g., an example of waveguide antenna 102*a*. A combination of the waveguide antennas 102*a* may form the phased antenna array 102, as will be described below.

Referring to FIGS. 13 to 15, the waveguide antenna 102*a* (e.g., a radiator) may have a metal or may have a metalized hollow structure, and include a waveguide 123 formed inside the metal or metalized hollow. On the inner walls that form the waveguide 123, protrusions 124*a*, 124*b*, 124*c*, etc., may be provided, and thus the waveguide 123 and/or the waveguide antenna 102*a* may have a compound cross-section. In an embodiment, the waveguide 123 may be a hollow waveguide open to the reflector (e.g., the reflector 101 of FIG. 6) on one side (e.g., a first side F1) of the waveguide antenna 102*a* and closed on the opposite side (e.g., a second side F2). The closed cross-section of the waveguide 123 may provide a reflecting face, and the waveguide 123 may emit waves through the open cross-section. The shape and size of the cross-section of the waveguide 123 may meet the general principle of radio waves propagation. For example, since the size of the cross-section of the waveguide may determine a critical value (e.g., a critical frequency) that cuts off penetration of radio waves, the size of the cross-section of the waveguide 123 may be suitably designed taking into account the critical value. The size, shape, etc., of the cross-section of the waveguide as described above may be adjusted by the protrusion 124*a*, 124*b* and 124*c*.

In various embodiments, the waveguide antenna 102*a* may include at least one microstrip lines 127*a* and 127*b* for providing a feed into the waveguide 123. In some embodiments, the microstrip lines 127*a* and 127*b* may be formed and supported on printed circuit boards 125*a* and 125*b*, and one end of the microstrip lines 127*a* and 127*b* extends to the inside of the waveguide 123 to form an excitation waveguide probe inside the waveguide 123. In an embodiment, an end (e.g., an excitation probe) of the microstrip lines 127*a* and 127*b* may protrude into the waveguide 123 while being perpendicular to the inner wall (or the cross-section of the protrusion 124*a*, 124*b* and 124*c*) of the waveguide 123, the protruding length being substantially about ¾ of the height of the waveguide. The protruding length may vary depending on requirements for the waveguide antenna 102*a*. In another embodiment, the microstrip lines 127*a* and 127*b* may be formed on either side of the printed circuit board 125*a* and 125*b* to be symmetrically arranged.

In various embodiments, the waveguide antenna 102*a* may include a first waveguide member 121*a* having a first part 123*a* of the waveguide 123, and a second waveguide member 121*b* having a second part 123*b* of the waveguide 123. The microstrip lines 127*a* and 127*b* may be placed between the first waveguide member 121*a* and the second waveguide member 121*b*. The printed circuit boards 125*a* and 125*b* having the microstrip lines 127*a* and 127*b* may be placed on a plane perpendicular to a direction in which the waveguide 123 extends or to an axis parallel with the direction. For example, the printed circuit boards 125*a* and 125*b* may be placed between the first part 123 and the second part 123*b*, and thus clamped between the first and second waveguide members 121*a* and 121*b*. In some embodiments, the printed circuit board 125*a* and 125*b* (if there are many, one printed circuit board) may be placed at an about ¼ wavelength distance from the closed end of the waveguide 123, dividing the waveguide 123 into the first part 123*a* and the second part 123*b*.

In an embodiment, the first waveguide member 121*a* may be produced with e.g., a metal, and the first part 123*a* may be opened on a side directed toward the second waveguide member 121*b* and/or the reflector (e.g., the reflector 101 of FIG. 6) and closed on the opposite side, e.g., on the second side F2 of the waveguide antenna 102*a*. In another embodiment, the second waveguide member 121*b* may be produced with, e.g., a metal, and the second part 123*b* may be opened on both sides, e.g., the side directed toward the first waveguide member 121*a* and the side (e.g., the first side F1 of the waveguide antenna) directed toward the reflector (e.g., the reflector 101 of FIG. 6). For example, the waveguide 123 may be comprised of a combination of the first part 123*a* and the second part 123*b*.

According to various embodiments, the protrusion(s) 124*a*, 124*b* and 124*c* are for control of critical frequency, penetration of vertical and/or horizontal polarization, etc., and may have various shapes, sizes, positions, etc. For example, the protrusion(s) 124*a*, 124*b* and 124*c* may make the critical frequency of the waveguide antenna 102*a* low by adjusting e.g., the size of the cross-section of the waveguide 123. In an embodiment, the protrusion(s) 124*a*, 124*b* and 124*c* may be formed between the closed end of the waveguide 123 and one of the printed circuit boards (e.g., the printed circuit board denoted by 125*a*), between the other printed circuit board (e.g., the printed circuit board denoted by 125*b*) and the open end of the waveguide 123, and even in an opening 123*c* of a dummy waveguide member 121*c*, which will be described later, if there are a plurality of printed circuit boards 125*a* and 125*b*, and may have various shapes based on specifications required for the waveguide antenna 102*a*.

In various embodiments, the waveguide antenna 102*a* may further include furrows 129*a* and 129*b* formed in the first and second waveguide members 121*a* and 121*b*, respectively. If the printed circuit boards 125*a* and 125*b* are fixed between the first and second waveguide members 121*a* and 121*b*, the furrows 129*a* and 129*b* may be positioned to correspond to the areas in which microstrip lines 127*a* and 127*b* are formed. For example, the furrows 129*a* and 129*b* may prevent the microstrip lines 127*a* and 127*b* from coming into contact with the metal part of the first and/or second waveguide members 121*a* and 121*b*, and create an environment for propagation of TEM waves. The line width of the microstrip lines 127*a* and 127*b*, the width of each of the furrows 129*a*, 129*b*, etc., may be designed differently depending on e.g., impedance required for the waveguide antenna 102*a*.

In an embodiment, the printed circuit board 125*a* and 125*b* may be provided in the plural, and each printed circuit board may provide a different feeding structure. For example, the waveguide antenna 102*a* may perform dual-polarized beamforming by being fed through different feeding structures. More specifically, in a case that there are two printed circuit boards 125*a* and 125*b* provided, a microstrip line placed on the first one of the printed circuit boards 125*a* and 125*b* may be arranged in the direction perpendicular to a microstrip line placed on the second printed circuit board, and the waveguide 123 may create orthogonal dual polarizations (e.g., horizontal and vertical polarizations) by being fed from the respective microstrip lines 127*a* and 127*b*).

In some embodiments, if the waveguide antenna 102*a* includes a plurality of printed circuit boards 125*a* and 125*b*, there may be the dummy waveguide member 121*c* placed between the printed circuit boards 125*a* and 125*b*. In some embodiments, the dummy waveguide member 121*c* may have the same metal or metalized hollow structure as that of the first and/or second waveguide member 121*a* and 121*b*. For example, as the dummy waveguide member 121*c* is produced with a metal, it may include an opening 123*c* that corresponds to the first and/or second part 123*a* and 123*b* of the waveguide 123. In another embodiment, if the microstrip lines 127*a* and 127*b* are placed on either side of each of the printed circuit boards 125*a* and 125*b*, the dummy waveguide member 121*c* may also include furrows 129*c* that correspond to the areas in which the microstrip lines 127*a* and 127*b* are formed.

In various embodiments, the waveguide antenna 102*a* may include feeding terminals 227*a* and 227*b* formed on some of its sides. The feeding terminals 227*a* and 227*b* may partially include at least a combination of the microstrip lines 127*a* and 127*b* and the furrows 129*a* and 129*b*, and may each be connected to a wireless communication module (RFIC). In an embodiment, the first of the feeding terminals (e.g., the feeding terminal denoted by 227*a*) may be fed for creating vertical polarization, and the second feeding terminal (e.g., the feeding terminal denoted by 227*b*) may be fed for creating horizontal polarization. The wireless communication module RFIC may provide independent or identical feeding signals to the feeding terminals 227*a* and 227*b*.

The structure of the waveguide antenna 102*a* may be diversified depending on embodiments. For example, a single printed circuit board may be provided and microstrip lines may be provided on either side of the single printed circuit board. In an embodiment, on one side of the single printed circuit board, a plurality of microstrip lines may be arranged to cross one another at right angles to provide feed for dual polarization. In another embodiment, if the waveguide antenna 102*a* is an antenna that generates single polarization, the structure of arranging the printed circuit board, the microstrip lines, etc., may become a bit simpler. In yet another embodiment, if the waveguide antenna 102*a* is an antenna that generates single polarization, neighboring waveguide antennas may radiate differently polarized waves.

Figure 16:
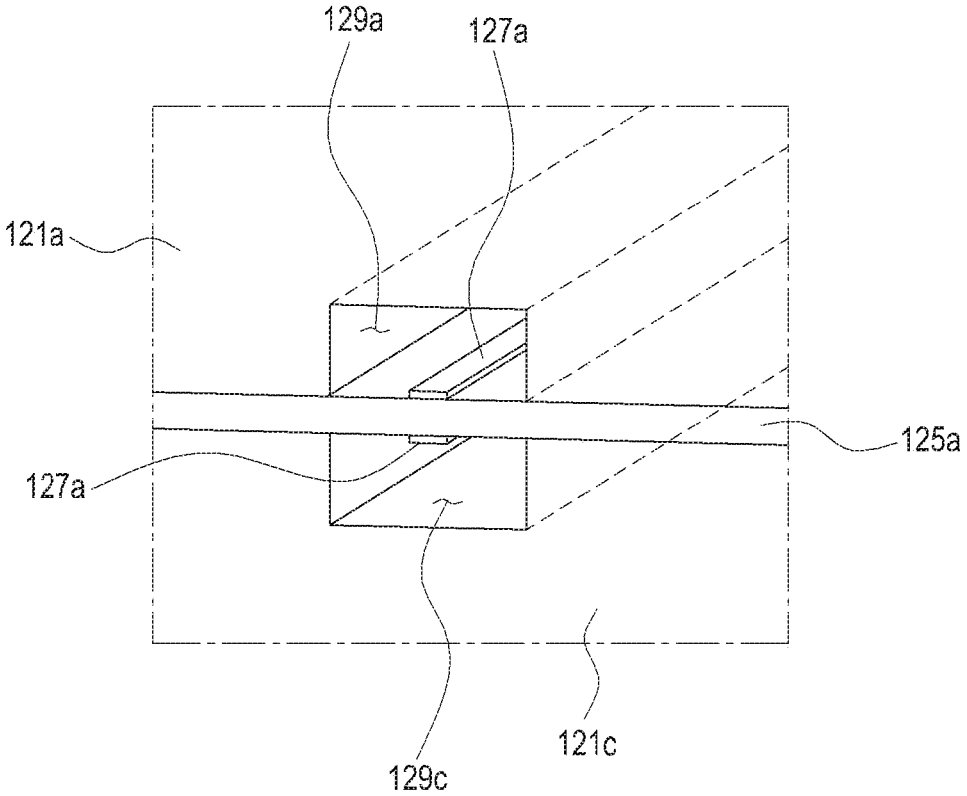
FIGS. 16 and 17 show feeding structures of an antenna device, according to various embodiments of the present disclosure.
Figure 17:
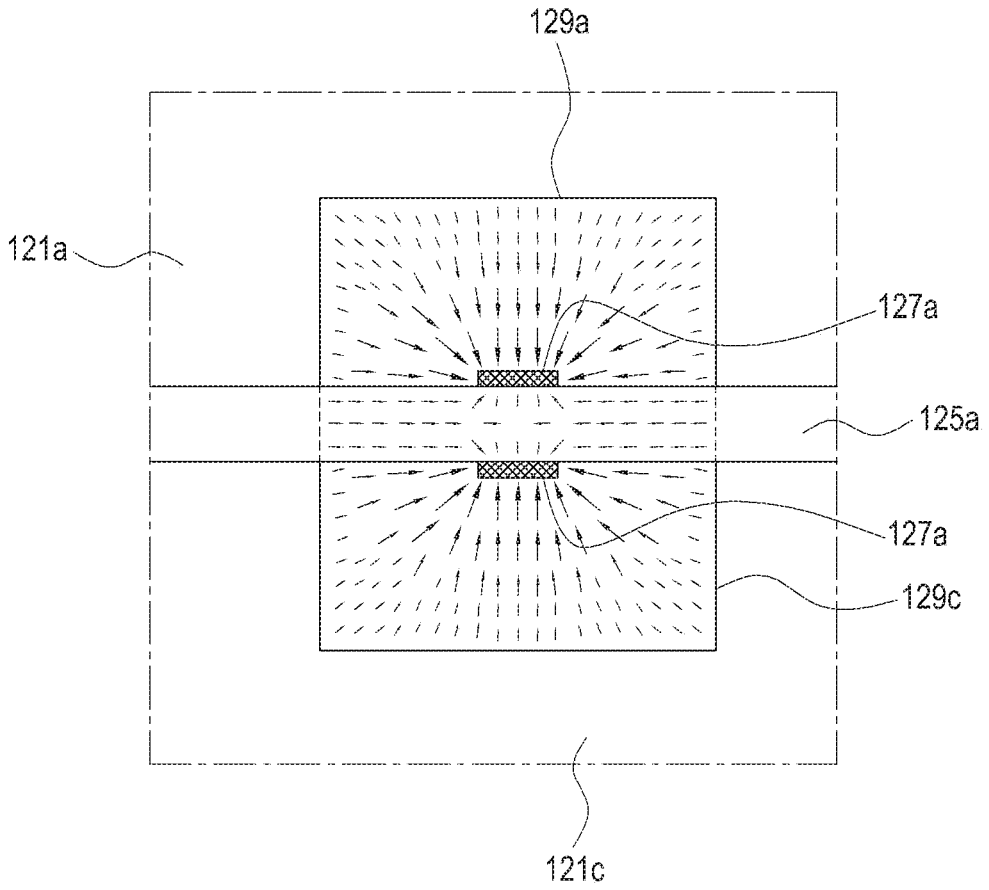

FIGS. 16 and 17 show feeding structures of an antenna device, according to various embodiments of the present disclosure.

Referring to FIGS. 16 and 17, the phased antenna array (e.g., the phased antenna array 102 of FIG. 12) and/or the waveguide antenna (e.g., the waveguide antenna 102*a* of FIG. 13) may include a fixed printed circuit board between the first waveguide member 121*a* and the dummy waveguide member 121*c*, and a feeding structure may be formed by combining the microstrip lines 127*a* and the furrows 129*a* and 129*c*. In some embodiments, with a single printed circuit board arranged, the printed circuit board may be fixed between the first and second waveguide members 121*a* and 121*b*. The microstrip lines 127*a*, as mentioned above, may be symmetrically arranged on either side of the printed circuit board 125*a*. The microstrip lines 127*a* may be placed in the space defined by the furrows 129*a* and 129*c* and some region of the printed circuit board 125*a* (e.g., an area in which the microstrip lines 127*a* are formed).

In various embodiments, if a feeding signal is applied to the aforementioned feeding structure, e.g., the feeding structure in which the microstrip lines 127*a* are placed in some space, distribution of the electromagnetic fields may be optimized to be concentrated in the air around the microstrip lines 127*a* (e.g., in the space in which the microstrip lines 127*a* are placed). This may substantially reduce the loss in the feeding structure and improve antenna efficiency. For example, the loss of a typical microstrip line with H=0.8 mm and frequency of 28 GHz using Taconic TLY-based dielectric is about 0.5 dB/cm, whereas in the feeding structure in accordance with various embodiments of the present disclosure, it may be seen that the loss of the microstrip lines 127*a* and 127*b* is merely about 0.1 dB/cm with an air filling structure in which the first and second waveguide members 121*a* and 121*b* (and/or the dummy waveguide member 121*c*) are used as ground and some space is formed around the microstrip lines 127*a* and 127*b*.

By arranging such feeding structures to be perpendicular to each other, dual-polarized beamforming is enabled, in which case cross-polarization may be suppressed to within about −15 dB and the antenna device (e.g., the antenna device 100 of FIG. 6) may maintain high efficiency. With the configuration, the antenna device in accordance with various embodiments of the present disclosure may form the required amplitude-phase distribution or shape of the radiation pattern in the elevation plane or horizontal plane to conform to particular conditions required depending on the installation environment.

Although somewhat different depending on the actual size, shape, etc., the antenna device (e.g., the antenna device 100 of FIG. 6) with a combination of the phased antenna array consisting of the waveguide antennas and a parabolic-hyperbolic profile may have a scan angle of about 60 degrees, enable dual-polarized beamforming with the feeding structures (e.g., the feeding structure of FIG. 16) of the waveguide antenna (e.g., the waveguide antenna 102*a* of FIG. 13), attain almost 74% of energy efficiency, and suppress the feeding loss to less than about 1.5 dB. The antenna device may conform to e.g., the next generation communication standard (e.g., fifth generation (5G) standard), and may be usefully used in mobile millimeter-wave networks, such as automobile radar, search radar, etc.

Figure 18:
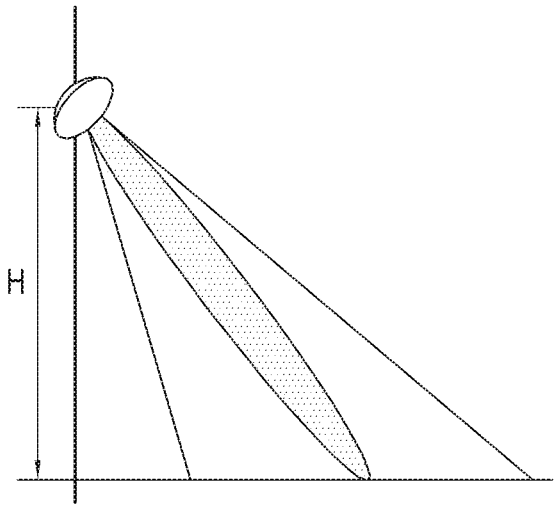
FIG. 18 (RELATED ART)
FIG. 18 shows a vertical (elevation) plane radiation pattern of an antenna device including a cylindrical or parabolic reflector of the related art according to an embodiment of the present disclosure.

FIG. 18 shows a vertical (elevation) plane radiation pattern of an antenna device including a cylindrical or parabolic reflector of the related art according to an embodiment of the present disclosure.

Figure 19:
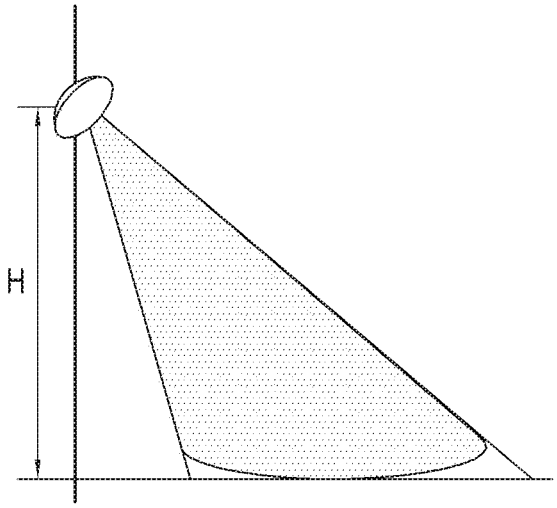
FIG. 19 shows a vertical plane radiation pattern of an antenna device, according to various embodiments of the present disclosure.

FIG. 19 shows a vertical plane radiation pattern of an antenna device, according to various embodiments of the present disclosure.

Referring to FIG. 18, since the antenna device of the related art is unable to secure a sufficient scan angle on a vertical plane, additional beam scanning may be required. The additional beam scanning may increase complexity of e.g., a controller, a distributor, and the like on the transceiver side. An additional antenna device needs to be installed to provide sufficient waves across the entire coverage area without the additional beam scanning.

Referring to FIG. 19, by applying in the elevation plane the cosecant pattern easily implemented by the antenna device (e.g., the antenna device 100 of FIG. 6), even without installation of additional beam scanning or additional antenna device, sufficient waves may be provided across a desired coverage area (at least the coverage area shown in FIG. 18), and a stable wireless communication environment may be provided without a loss of gain even at the edges of the coverage area.

In various embodiments, the antenna device may operate in multiple inputs multiple outputs (MIMO) mode.

Figure 20:
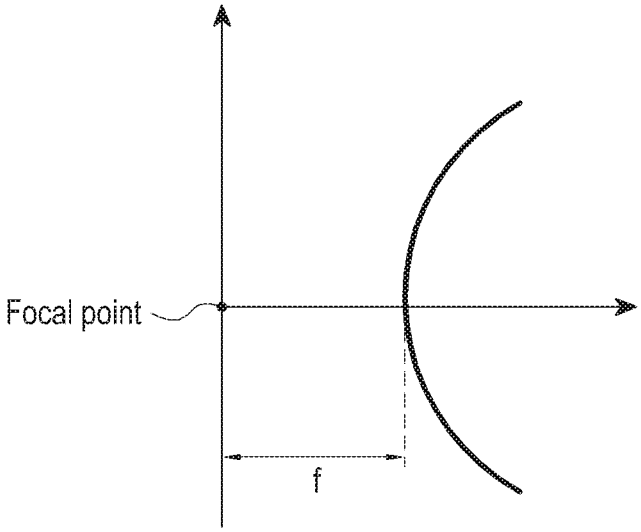
FIG. 20 shows calculation of a profile of a hyperbolic shape of a reflector in an antenna device according to various embodiments of the present disclosure.

FIG. 20 shows calculation of a profile of a hyperbolic shape of a reflector in an antenna device according to various embodiments of the present disclosure.

Referring to FIG. 20, in various embodiments of the present disclosure, the hyperbolic profile of a reflector (e.g., the reflector 102 of FIG. 6) may be calculated by the following Equation 2. In Equation 2, M is an initial parameter, which may be chosen from among a range of 1.3 to 1.6. If the initial parameter has a larger value out of the range, the scan angle may increase but the antenna gain may be reduced as illustrated in Equation 2 below:

$$x = a \times \mathrm{Cos}\ h(t)$$

$$y = b \times \mathrm{Sin}\ h(t) \qquad \text{Equation 2}$$

where $$a = \frac{f \times (M-1)}{2M},\ b = \sqrt{f \times (f-2a)},$$

t denotes a free parameter, and f denotes a focal distance (see FIG. 20).

In accordance with various embodiments of the present disclosure, an antenna device may include a reflector having a profile of a parabolic shape in a first cross-section cut parallel to a first direction and a profile of a hyperbolic shape in a second cross-section, the second cross-section being cut perpendicular to the first direction and crossing the first cross-section at right angle; and a radiating structure having at least one phased antenna array adapted to illuminate at least part of the reflector and to scan a beam, wherein edges of the profile of the parabolic shape of the first cross-section are formed to be directed toward the radiating structure, and edges of the profile of the hyperbolic shape of the reflector are formed to be directed away from the radiating structure.

In various embodiments, the phased antenna array may include linearly-arranged phased antennas.

The phased antennas are placed on the same plane as one of the second cross-sections, and arranged to be orthogonal to the symmetry axis of the profile of the hyperbolic shape.

In various embodiments, the radiating structure may include at least two phased antenna arrays, which may be arranged to illuminate different parts of the reflector.

In various embodiments, the phased antenna array may perform dual-polarized beamforming.

In various embodiments, the phased antennas constituting the phased antenna array may include waveguide antennas.

In various embodiments, the waveguide antenna may include a waveguide with a side directed toward the reflector open and the opposite side closed.

The waveguide may be formed inside a metal or metalized hollow.

In various embodiments, the waveguide antenna may include a waveguide having a metal or metalized hollow; and a microstrip line providing feed into the waveguide.

In various embodiments, the waveguide antenna may include a first waveguide member having a first part of the waveguide; a second waveguide member having a second part of the waveguide; and at least one printed circuit board having the microstrip line, wherein the printed circuit board is arranged on a plane perpendicular to an axis of the waveguide between the first and second parts to be clamped between the first and second waveguide members.

In various embodiments, the waveguide antenna may further comprise furrows formed in the first and second waveguide members, and the furrows may be formed to correspond to areas in which the microstrip lines are formed.

In various embodiments, the microstrip line may linearly extend on the printed circuit board, and one end of the microstrip line extends into the waveguide and is arranged to form a right angle with an inner wall of the waveguide, thereby forming an excitation waveguide probe in the waveguide.

In various embodiments, the microstrip lines may be symmetrically arranged on either side of the printed circuit board.

In various embodiments, the waveguide antenna may include two of the printed circuit boards, and the microstrip line placed on one of the printed circuit boards may be arranged to be perpendicular to the other microstrip line placed on the other printed circuit board.

In various embodiments, the waveguide antenna may include a dummy waveguide member arranged between two of the printed circuit boards.

In various embodiments, the dummy waveguide may include an opening corresponding to the first part or the second part.

In various embodiments, the waveguide antenna may further include protrusions formed along the inner wall of the waveguide, and the protrusions may lower the critical frequency of the waveguide antenna.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna device comprising:

a reflector having a profile of a parabolic shape in a first cross-section cut parallel to a first direction and a profile of a hyperbolic shape in a second cross-section, the second cross-section being cut perpendicular to the first direction and crossing the first cross-section at a right angle; and a radiating structure having at least one phased antenna array adapted to illuminate at least part of the reflector and to scan a beam, wherein edges of the profile of the parabolic shape of the first cross-section are formed to be directed toward the radiating structure, and wherein edges of the profile of the hyperbolic shape of the reflector are formed to be directed away from the radiating structure.

2. The antenna device of claim 1, wherein the phased antenna array comprises linearly-arranged phased antennas, and wherein the phased antennas are placed on a same plane as one of the second cross-sections, and wherein the phased antennas are configured to be orthogonal to a symmetry axis of the profile of the hyperbolic shape.

3. The antenna device of claim 1, wherein the radiating structure comprises at least two phased antenna arrays, and wherein each of the at least two phased antenna arrays are configured to illuminate a different part of the reflector.

4. The antenna device of claim 1, wherein the phased antenna array is configured to perform dual-polarized beamforming.

5. The antenna device of claim 1, wherein the phased antenna array comprises phased antennas, and wherein the phased antenna comprises a waveguide antenna.

6. The antenna device of claim 5, wherein the waveguide antenna comprises a waveguide with a side directed toward the reflector open and the opposite side closed, and wherein the waveguide is formed inside one of a metal hollow or a metalized hollow.

7. The antenna device of claim 5, wherein the waveguide antenna comprises a waveguide formed in a metal or metalized hollow; and a microstrip line for providing feed into the waveguide.

8. The antenna device of claim 7, wherein the waveguide antenna comprises:

a first waveguide member having a first part of the waveguide, a second waveguide member having a second part of the waveguide, and at least one printed circuit board having the microstrip line, and wherein the printed circuit board is arranged on a plane perpendicular to an axis of the waveguide between the first part and the second part to be clamped between the first waveguide member and the second waveguide member.

9. The antenna device of claim 8, wherein the waveguide antenna further comprises:

furrows formed in the first waveguide member and the second waveguide member, respectively, and wherein the furrows are configured to correspond to an area in which the microstrip line is formed.

10. The antenna device of claim 8, wherein the microstrip line linearly extends on the printed circuit board, and wherein one end of the microstrip line is configured to:

extend into the waveguide, and form a right angle with an inner wall of the waveguide, to form an excitation waveguide probe in the waveguide.

11. The antenna device of claim 8, wherein microstrip lines are symmetrically arranged on either side of the printed circuit board.

12. The antenna device of claim 8, wherein the waveguide antenna comprises two of the printed circuit boards, and wherein the microstrip line placed on one of the printed circuit boards is arranged to be perpendicular to the other micro strip line placed on the other printed circuit board.

13. The antenna device of claim 9, wherein the furrows are placed in the first waveguide member and the second waveguide members based upon an impedance requirement for the waveguide antenna.

14. The antenna device of claim 12, wherein the waveguide antenna further comprises a dummy waveguide member arranged between two of the printed circuit boards.

15. The antenna device of claim 14, wherein the dummy waveguide comprises an opening corresponding to the first part or the second part.

16. The antenna device of claim 7, wherein the waveguide antenna further comprises protrusions formed along an inner wall of the waveguide, and the protrusions are configured to lower a critical frequency of the waveguide antenna.

* * * * *